US007793791B1

(12) United States Patent
Pouille

(10) Patent No.: US 7,793,791 B1
(45) Date of Patent: Sep. 14, 2010

(54) FILING ASSEMBLY

(76) Inventor: Oliver R. Pouille, 1040 Fairview La., Riviera Beach, FL (US) 33404

( * ) Notice: Subject to any disclaimer, the term of this patent is extended or adjusted under 35 U.S.C. 154(b) by 305 days.

(21) Appl. No.: 11/923,824

(22) Filed: Oct. 25, 2007

(51) Int. Cl.
*A47F 7/16* (2006.01)

(52) U.S. Cl. ..... 211/46; 312/216; 312/184

(58) Field of Classification Search ..... 211/46, 211/10, 11, 84, 85.17, 85.29, 113, 162, 126.13; 312/183, 184, 185, 187, 193, 262, 259, 350, 312/901, 216, 107.5, 107; 206/425; 229/67.1, 229/67.2

See application file for complete search history.

(56) References Cited

U.S. PATENT DOCUMENTS

| | | | | | |
|---|---|---|---|---|---|
| 254,836 | A | * | 3/1882 | Naureth | 211/50 |
| 321,164 | A | * | 6/1885 | West | 211/46 |
| 2,174,201 | A | * | 9/1939 | Chauvin | 211/46 |
| 2,253,788 | A | * | 8/1941 | Kern | 211/45 |
| 2,483,046 | A | * | 9/1949 | Heckert | 211/126.13 |
| 2,599,240 | A | * | 6/1952 | Ellerson | 312/334.7 |
| 3,628,842 | A | * | 12/1971 | Wright | 312/259 |
| 3,647,076 | A | | 3/1972 | Heimann | |
| 3,740,109 | A | * | 6/1973 | Pfaffendorf et al. | 312/261 |
| 3,798,810 | A | * | 3/1974 | Brisson et al. | 40/375 |
| 3,836,219 | A | * | 9/1974 | Guest et al. | 312/183 |
| 3,913,995 | A | | 10/1975 | Malcik et al. | |
| 4,277,120 | A | * | 7/1981 | Drake et al. | 312/223.1 |
| 4,666,047 | A | | 5/1987 | Fletcher | |
| 4,907,706 | A | * | 3/1990 | Henderson | 211/46 |
| 4,998,630 | A | * | 3/1991 | Schwartz | 211/85.15 |
| 5,031,782 | A | * | 7/1991 | Minervini | 211/46 |
| D365,225 | S | | 12/1995 | Poortvliet et al. | |
| 5,630,658 | A | | 5/1997 | Jeter | |
| 5,680,938 | A | | 10/1997 | Rubinstein | |
| D407,441 | S | | 3/1999 | Greenberg et al. | |
| 6,648,153 | B2 | * | 11/2003 | Holmes | 211/85.15 |

* cited by examiner

*Primary Examiner*—Darnell M Jayne
*Assistant Examiner*—Stanton L Krycinski

(57) ABSTRACT

A filing assembly includes a housing with a top wall, a bottom wall, a first lateral wall and a second lateral wall. The housing has an open front side. A plurality of rails is attached to a bottom side of the top wall. A receiving space is defined between adjacent ones of the rails. Each of a plurality of hanging folders includes a panel that has first lateral edge, a second lateral edge, a front edge and a rear edge. The panel has a bend therein extending from the front edge to the rear edge. A plurality of connectors is also provided. Each of the first and second lateral edges has one of the connectors attached thereto. Each of the receiving spaces slidably receives one of the connectors. Secondary folders or papers are positionable in the hanging folders.

12 Claims, 4 Drawing Sheets

FILING ASSEMBLY

BACKGROUND OF THE INVENTION

Field of the Invention

The present invention relates to file folder holding devices and more particularly pertains to a new file folder holding device for providing a hanging folder which is stable and will not easily fall from its supports.

SUMMARY OF THE INVENTION

The present invention meets the needs presented above by generally comprising a housing has a top wall, a bottom wall, a first lateral wall and a second lateral wall. The housing has an open front side defined by a front edge of the top, bottom, first lateral and second lateral walls. A plurality of rails is attached to a bottom side of the top wall and extends from the front edge of the top wall to a back edge of the top wall. The rails are oriented parallel to each other and each has a longitudinal axis oriented parallel to a plane of the first lateral wall. The rails are spaced from each other. A receiving space is defined between adjacent ones of the rails. A plurality of hanging folders is provided and each comprises a panel that has first lateral edge, a second lateral edge, a front edge and a rear edge. The panel has a bend therein extends from the front edge to the rear edge and is positioned between the first and second lateral edges to position the first and second lateral edges adjacent to each other. A plurality of connectors is also provided. Each of the first and second lateral edges has one of the connectors attached thereto. Each of the receiving spaces slidably receives one of the connectors. Secondary folders or papers are positionable in the hanging folders.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
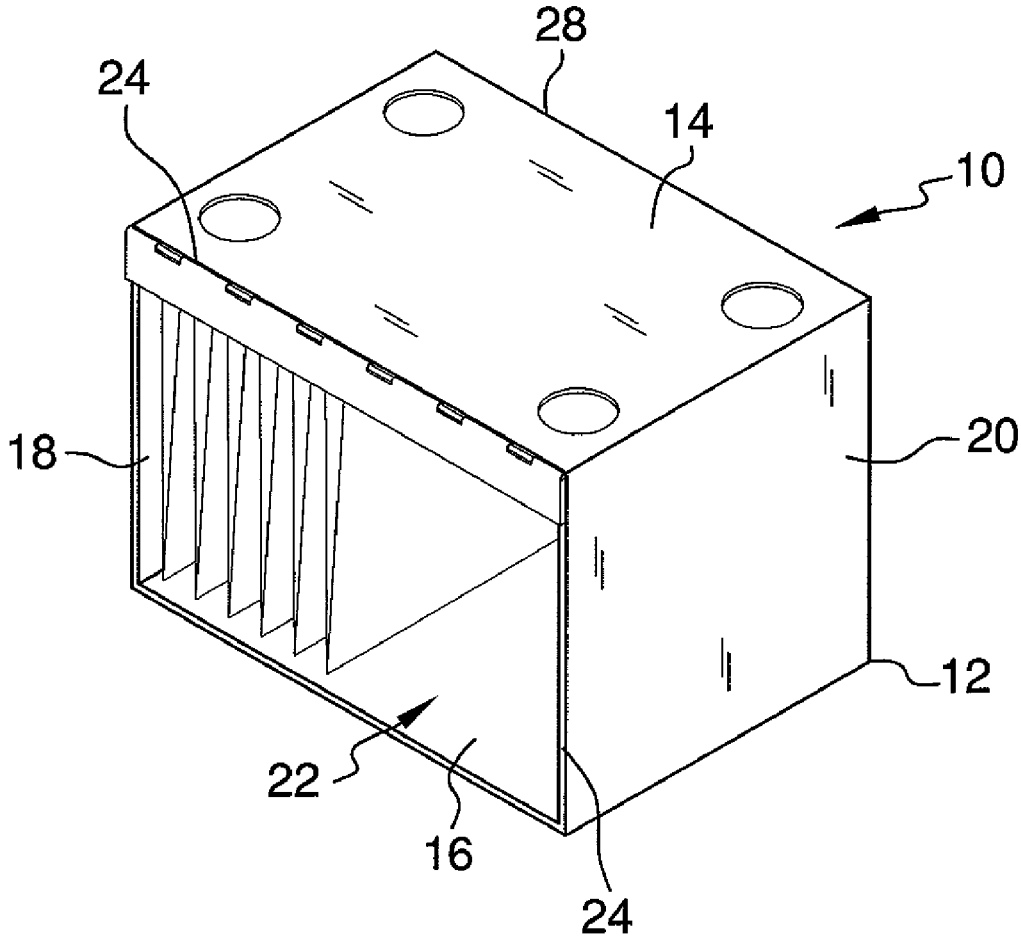
FIG. 1 is a perspective view of a filing assembly according to the present invention.

With reference now to the drawings, and in particular to FIGS. 1 through 6 thereof, a new file folder holding device embodying the principles and concepts of the present invention and generally designated by the reference numeral 10 will be described.

As best illustrated in FIGS. 1 through 6, the filing assembly 10 generally comprises a housing 12 that has a top wall 14, a bottom wall 16, a first lateral wall 18 and a second lateral wall 20. The housing 12 has an open front side 22 defined by a front edge 24 of the top 14, bottom 16, first lateral 18 and second lateral 20 walls.

A plurality of rails 26 is attached to a bottom side of the top wall 14 and extends from the front edge 24 of the top wall 14 to a back edge 28 of the top wall 14. The rails 26 are oriented parallel to each other and each has a longitudinal axis oriented parallel to a plane of the first lateral wall 18. The rails 26 are spaced from each other and each includes a support 30 extending downwardly from the top wall 14 and a shoulder 32 attached to a bottom side of the support 30 to form an upside down T-shape. A receiving space 34 is defined between shoulders 32 of adjacent ones of the rails 26.

Figure 6:
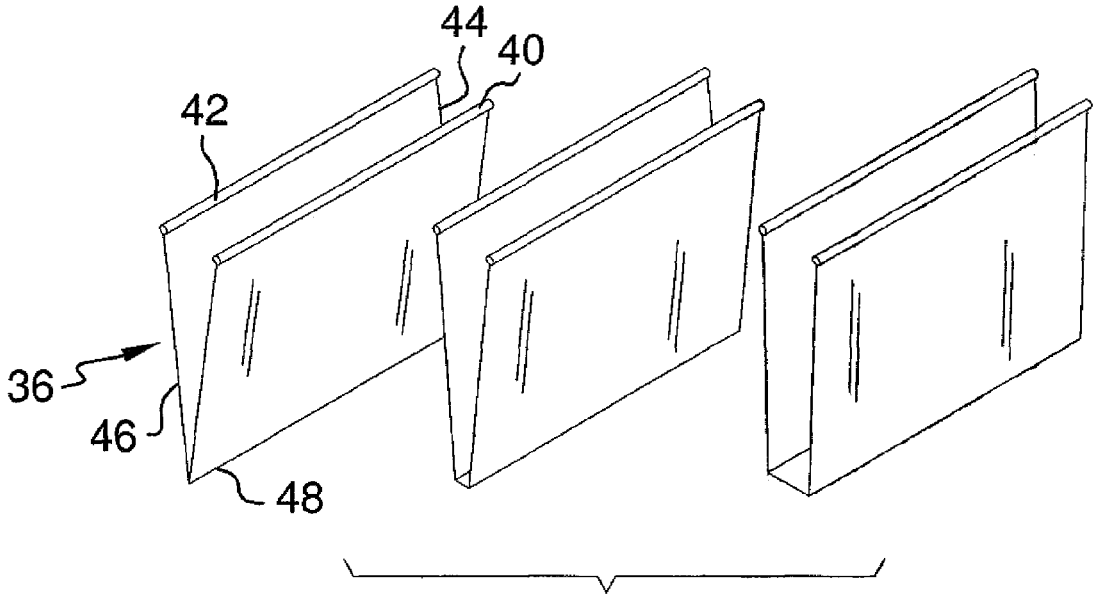
FIG. 6 is a perspective view of a variety of folders the present invention.

A plurality of hanging folders 36 is provided. Each of the hanging folders 36 comprises a panel 38 that has first lateral edge 40, a second lateral edge 42, a front edge 44 and a rear edge 46. The panel 36 has a bend 48 therein extending from the front edge 44 to the rear edge 46 and is positioned between the first 40 and second 42 lateral edges to position the first 40 and second 42 lateral edges adjacent to each other. FIG. 6 shows a plurality of different hanging folders 46 having different widths.

Figure 2:
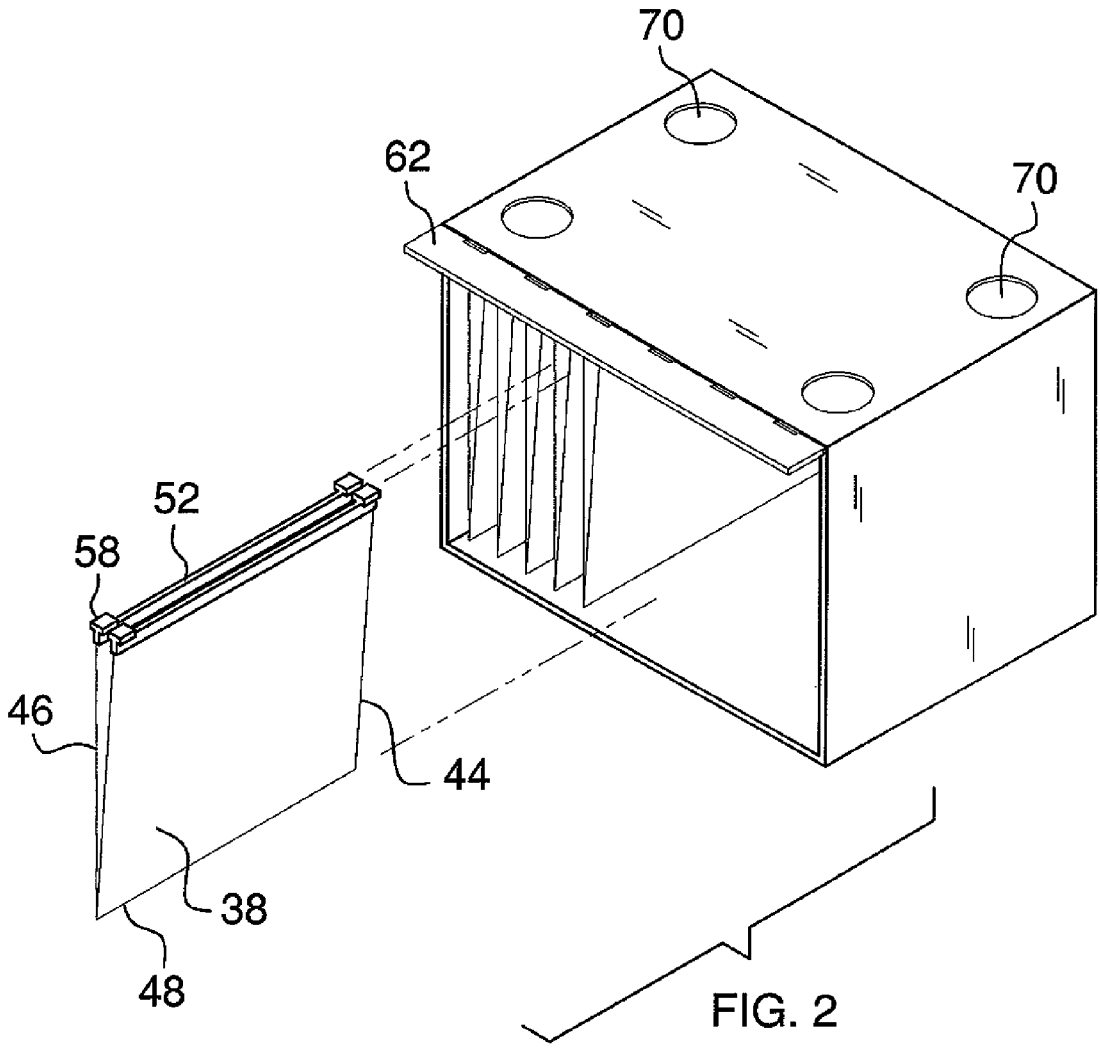
FIG. 2 is a perspective view of the present invention.
Figure 3:
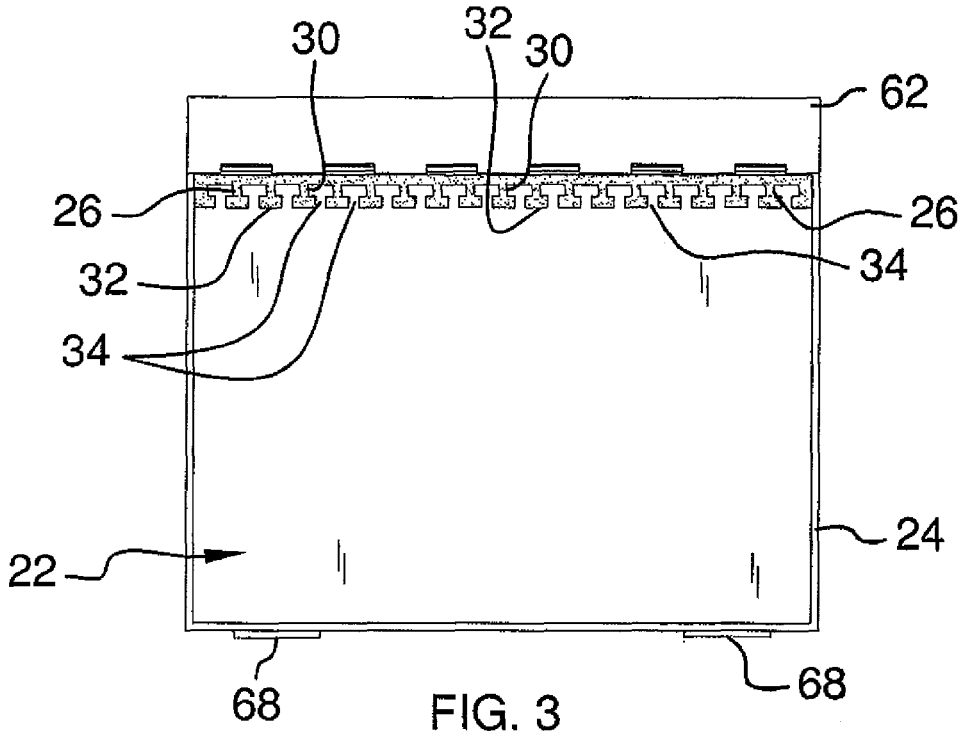
FIG. 3 is a front view of the present invention.
Figure 4:
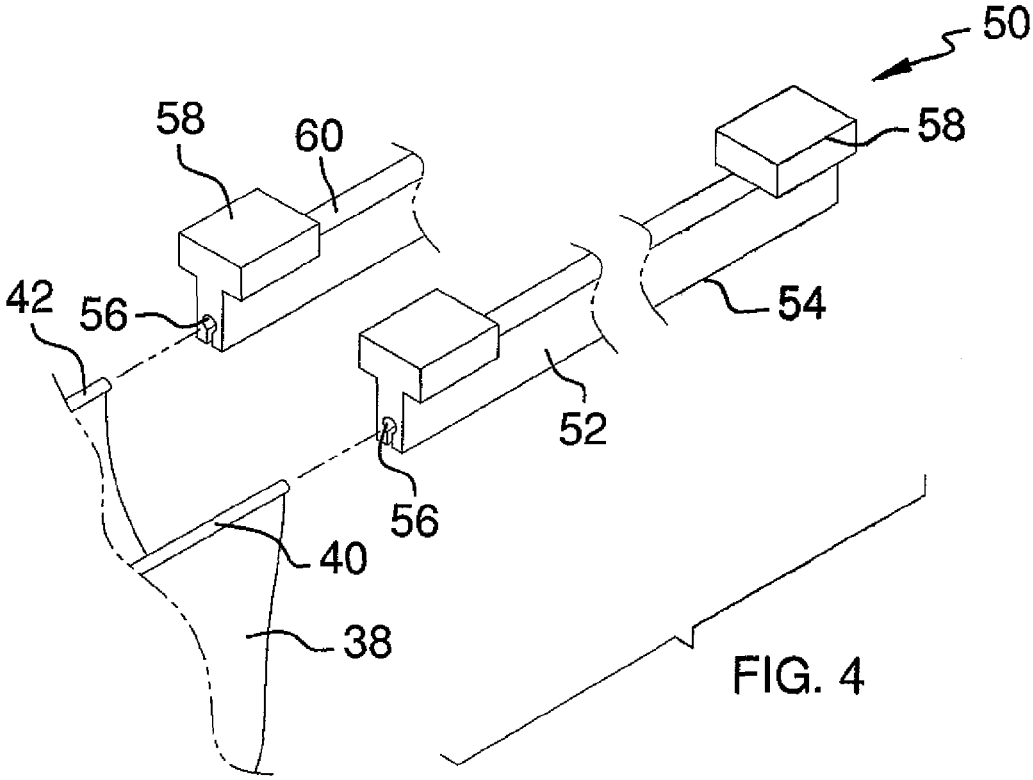
FIG. 4 is an enlarged perspective view of a coupler of the present invention.
Figure 5:
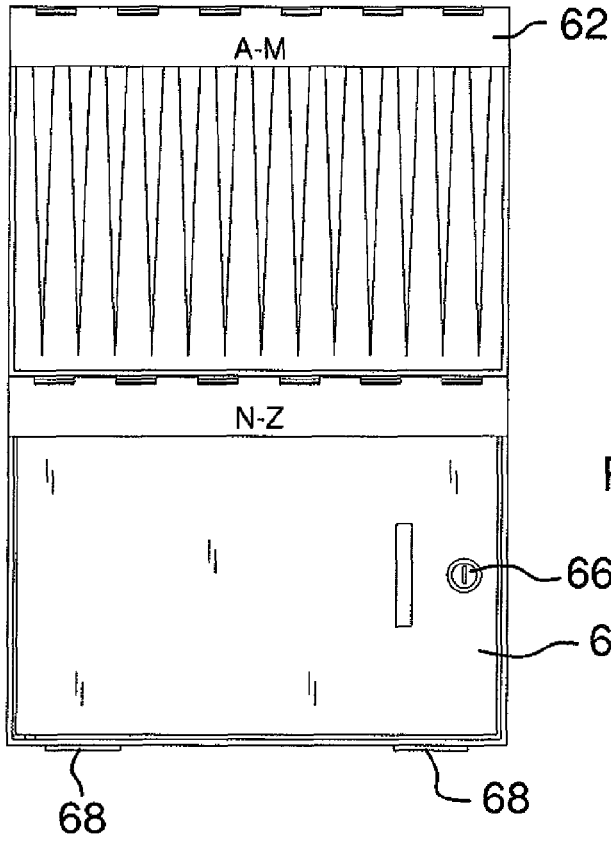
FIG. 5 is a front view of the present invention.

A plurality of connectors 50 is also provided. Each of the first 40 and second 42 lateral edges has one of the connectors 50 attached thereto. The receiving spaces 34 each slidably receive one of the connectors 50. Each of the first 40 and second 42 lateral edges is rounded and each of the connectors 50 includes an elongated member 52 that has a bottom edge 54 having a slot 56 therein for receiving one of the first 40 or second 42 lateral edges. The connectors 50 also each include at least one flange 58 that is attached to a top side 60 of the elongated member 52. The at least one flange 58 is positionable on a pair of adjacent ones of the shoulders 32. FIG. 2 shows connectors with a pair of flanges 58 and may include a single flange 58 extending the length of the elongated member 52.

A retaining plate 62 is hingedly coupled to the front edge 24 of the top wall 14 and is coextensive with the top wall 14. The retaining plate 62 is positionable in a first position hanging down in front of the rails 26 or in a second position allowing access to the rails 26. The retaining plate 62 restricts removal of the hanging folders 36 when the retaining plate 62 is in the first position. The retaining plate 62 only hangs between 1 and 3 inches downwardly from the top wall 14 and the housing 12 has a height between 8 inches and 16 inches.

A door 64 is pivotally coupled to the housing 12 adjacent to the front edge 24 of the first lateral wall 18 to selectively open or close the open front side 22 of the housing 12. A conventional lock 66 is positioned on the door 64 to selectively secure the door 64 in a closed position.

A plurality of feet 68 is attached to a bottom surface of the bottom wall 16. The top wall 14 has a plurality of indentations 70 therein. Each of the indentations 70 is aligned with one of the feet 68. The indentations 70 are positioned to receive feet 68 of another housing 12 to allow stacking of a plurality of housings 12 as shown in FIG. 6.

In use, in use, the hanging folders 36 are extended into the housing 12 and mounted on the rails 26 as described above and as shown in the Figures. The rails 26 retain a fixed width of the hanging folders 36 and thereby prevent the hanging folders 36 from being over filled. The rails 26 also do not allow the hanging folders to slip from their mounts which can happen in traditional drawer type hanging folder systems. Once the hanging folders 36 are mounted on the rails 26, secondary folders and/or papers are positionable in then.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A file holding and organizing assembly comprising:

a housing having a top wall, a bottom wall, a first lateral wall and a second lateral wall, said housing having an open front side defined by a front edge of said top, bottom, first lateral and second lateral walls;

a plurality of rails being attached to a bottom side of said top wall and extending from said front edge of said top wall to a back edge of said top wall, said rails being oriented parallel to each other and each having a longitudinal axis oriented parallel to a plane of said first lateral wall, said rails being spaced from each other, a receiving space being defined between adjacent ones of said rails, each of said rails includes a support extending downwardly from said top wall and a shoulder attached to a bottom side of said support to form an upside down T-shape, said receiving space being defined between shoulders of adjacent ones of said rails;

a plurality of hanging folders, each of said hanging folders comprising a panel having a first lateral edge, a second lateral edge, a front edge and a rear edge, said panel having a bend therein extending from said front edge to said rear edge and being positioned between said first and second lateral edges to position said first and second lateral edges adjacent to each other;

a plurality of connectors, each of said first and second lateral edges having one of said connectors attached thereto, each of said receiving spaces slidably receiving one of said connectors, each of said first and second lateral edges are rounded, each of said connectors including an elongated member having a bottom edge having a slot therein for receiving one of said first or second lateral edges and at least one flange being attached to a top side of said elongated member, said at least one flange being positionable on a pair of adjacent ones of said shoulders; and wherein secondary folders or papers are positionable in said hanging folders.

2. The assembly according to claim 1, further including a retaining plate being hingedly coupled to said front edge of said top wall and being coextensive with said top wall, said retaining plate being positionable in a first position hanging down in front of said rails or in a second position allowing access to said rails, said retaining plate restricting removal of said hanging folders when said retaining plate is in said first position.

3. The assembly according to claim 2, further including a door being pivotally coupled to said housing adjacent to said front edge of said first lateral wall to selectively open or close said open front side of said housing.

4. The assembly according to claim 3, further including a lock being positioned on said door to selectively secure said door in a closed position.

5. The assembly according to claim 1, further including a door being pivotally coupled to said housing adjacent to said front edge of said first lateral wall to selectively open or close said open front side of said housing.

6. The assembly according to claim 5, further including a lock being positioned on said door to selectively secure said door in a closed position.

7. The assembly according to claim 1, further including a plurality of feet being attached to a bottom surface of said bottom wall.

8. The assembly according to claim 7, wherein said top wall has a plurality of indentations therein, each of said indentations being aligned with one of said feet, said indentations being positioned to receive feet of another housing to allow stacking of housings.

9. The assembly according to claim 2, further including a plurality of feet being attached to a bottom surface of said bottom wall.

10. The assembly according to claim 9, wherein said top wall has a plurality of indentations therein, each of said indentations being aligned with one of said feet, said indentations being positioned to receive feet of another housing to allow stacking of housings.

11. The assembly according to claim 10, further including a door being pivotally coupled to said housing adjacent to said front edge of said first lateral wall to selectively open or close said open front side of said housing.

12. A file holding and organizing assembly comprising:

a housing having a top wall, a bottom wall, a first lateral wall and a second lateral wall, said housing having an open front side defined by a front edge of said top, bottom, first lateral and second lateral walls;

a plurality of rails being attached to a bottom side of said top wall and extending from said front edge of said top wall to a back edge of said top wall, said rails being oriented parallel to each other and each having a longitudinal axis oriented parallel to a plane of said first lateral wall, said rails being spaced from each other, each of said rails including a support extending downwardly from said top wall and a shoulder attached to a bottom side of said support to form an upside down T-shape, a receiving space being defined between shoulders of adjacent ones of said rails;

a plurality of hanging folders, each of said hanging folders comprising a panel having first lateral edge, a second lateral edge, a front edge and a rear edge, said panel having a bend therein extending from said front edge to said rear edge and being positioned between said first and second lateral edges to position said first and second lateral edges adjacent to each other;

a plurality of connectors, each of said first and second lateral edges having one of said connectors attached thereto, each of said receiving spaces slidably receiving one of said connectors, each of said first and second lateral edges being rounded, each of said connectors including an elongated member having a bottom edge having a slot therein for receiving one of said first or second lateral edges and at least one flange being attached to a top side of said elongated member, said at least one flange being positionable on a pair of adjacent ones of said shoulders;

a retaining plate being hingedly coupled to said front edge of said top wall and being coextensive with said top wall, said retaining plate being positionable in a first position hanging down in front of said rails or in a second position allowing access to said rails, said retaining plate restricting removal of said hanging folders when said retaining plate is in said first position;

a door being pivotally coupled to said housing adjacent to said front edge of said first lateral wall to selectively open or close said open front side of said housing, a lock being positioned on said door to selectively secure said door in a closed position;

a plurality of feet being attached to a bottom surface of said bottom wall, said top wall having a plurality of indentations therein, each of said indentations being aligned with one of said feet, said indentations being positioned to receive feet of another housing to allow stacking of housings; and wherein secondary folders or papers are positionable in said hanging folders.

* * * * *